US006945006B2

(12) United States Patent
Stoffer

(10) Patent No.: US 6,945,006 B2
(45) Date of Patent: Sep. 20, 2005

(54) COUNTERTOP ASSEMBLY AND METHOD OF MANUFACTURE THEREOF

(75) Inventor: John F. Stoffer, North Canton, OH (US)

(73) Assignee: American Marble Industries, Canton, OH (US)

( * ) Notice: Subject to any disclaimer, the term of this patent is extended or adjusted under 35 U.S.C. 154(b) by 169 days.

(21) Appl. No.: 10/091,659

(22) Filed: Mar. 5, 2002

(65) Prior Publication Data

US 2002/0124525 A1 Sep. 12, 2002

Related U.S. Application Data

(60) Provisional application No. 60/274,816, filed on Mar. 9, 2001.

(51) Int. Cl.[7] ..... E04C 2/38

(52) U.S. Cl. ..... 52/716.1; 52/287.1; 52/288.1; 52/311.1; 52/311.2; 52/311.3; 52/782.2; 52/800.1; 52/802.1; 52/802.11; 52/716.6; 52/716.8; 52/718.04; 52/717.05; 52/745.19

(58) Field of Search ..... 52/745.19, 748.1, 52/782.2, 800.1, 802.1, 802.11, 718.04, 255, 287.1, 288.1, 311.1, 311.2, 311.3, 312, 290, 511, DIG. 13, 716.1–717.06

(56) References Cited

U.S. PATENT DOCUMENTS 2,297,072 A * 9/1942 Raggio
2,717,187 A * 9/1955 Morgan et al.
4,008,549 A * 2/1977 Dobija ..... 52/287.1
4,912,900 A * 4/1990 Yeamans ..... 52/273
4,996,817 A * 3/1991 Nelson ..... 52/783
5,073,430 A * 12/1991 Aidan ..... 428/43
5,157,886 A * 10/1992 Azzar et al. ..... 52/717.05
5,157,891 A * 10/1992 Nelson ..... 52/783
5,398,469 A * 3/1995 Logan ..... 52/288.1
5,457,923 A * 10/1995 Logan et al. ..... 52/288.1
5,469,685 A * 11/1995 Nelson ..... 52/782.2
5,496,609 A * 3/1996 Michelstein ..... 428/71
5,501,047 A * 3/1996 Delaunay et al. ..... 52/273
5,613,342 A * 3/1997 Nelson ..... 52/782.2
5,662,753 A * 9/1997 Loos ..... 156/71
5,694,726 A * 12/1997 Wu ..... 52/287.1
5,711,123 A * 1/1998 Lamont et al. ..... 52/287.1
5,819,485 A * 10/1998 Lane et al. ..... 52/287.1
5,953,881 A * 9/1999 Sherry ..... 52/746.1
6,044,601 A * 4/2000 Chmela et al. ..... 52/287.1
6,183,585 B1 * 2/2001 Kelley ..... 156/182
6,360,503 B1 * 3/2002 Koenig, Jr. ..... 52/287.1
6,413,337 B2 * 7/2002 Sciarrino et al. ..... 156/71
6,453,638 B2 * 9/2002 Chen ..... 52/784.15
6,553,732 B2 * 4/2003 Shaw ..... 52/287.1

* cited by examiner

*Primary Examiner*—Jeanette E. Chapman
(74) *Attorney, Agent, or Firm*—Sand & Sebolt

(57) ABSTRACT

A countertop assembly comprising a horizontal deck having an upper and a lower surface and an elongated vertical edge surface and an elongated molded strip superimposed on the vertical surface. A pattern formed from either ridges or recesses or a combination of ridges and recesses may be molded into the front side of the elongated molded strip. A method of manufacturing this countertop assembly is also disclosed.

40 Claims, 5 Drawing Sheets

COUNTERTOP ASSEMBLY AND METHOD OF MANUFACTURE THEREOF

This applicaton claims benefit of 60/274,816 filed on Mar. 9, 2001.

BACKGROUND OF THE INVENTION

1. Technical Field

The present invention relates to static structure and more particularly to panels having a discrete edgewise connecting feature. Still more particularly, the present invention relates to countertops and more particularly to face strips for edges of the horizontal panels of countertops and to methods of attaching such face strips and assembling such.

2. Background Information

When laminates or veneers are used on both the horizontal upper surface and the vertical front edge of countertops, such as kitchen cabinets, tables, furniture and the like, a sharp right angled corner is formed between such horizontal and vertical surfaces. Because of its sharpness, this corner may be easily damaged, and, when damaged, it is difficult to repair. Furthermore, such sharp corners may not be as aesthetically pleasing as a rounded corner in many countertop applications. Still further, when laminates or veneers are joined at right angles with respect to one another, a conspicuous black line may be created at their intersection by one of the laminate or veneer pieces.

Consequently, the prior art has taught arrangements in which a curved elongated finished surface is interposed between the horizontal surface and the vertical edge. While such curved finished surfaces provide both structural and aesthetic advantages over squared corners for many uses, they are ordinarily manufactured by extrusion or by use of a router so that few variations in surface features of the end product would usually be available. Furthermore, the materials from which such curved finished surfaces may be extruded may have a limited variety of characteristics so that various characteristics in the way of durability, finishes and colors may not be available.

A need, therefore, exists for a way of presenting a variety of three dimensional patters in the curved front edge of a countertop.

A need also exists for a way of using a variety of materials which have advantageous characteristics in terms of durability, finish, color and other factors may be used in the face strip covering the front edge of a countertop.

SUMMARY OF THE INVENTION

It is an object of the present invention to provide a curved front edge or other shapes for a countertop and a method for its construction in which a large variety of aesthetically pleasing patterns may be presented which patterns are discontinuous along the length of the edge.

It is another object of the present invention to provide a rounded front edge for a countertop and a method for its manufacture in which a variety of materials having advantageous characteristics in terms of durability, finish, color and other factors may be used.

These and other objectives are provided by the present invention which is a countertop assembly comprising a horizontal deck having an upper and a lower surface and an elongated vertical edge surface and an elongated molded strip superimposed on the vertical surface.

The present invention also encompasses a method for the manufacture of such a countertop in which a horizontal deck having an upper and lower surface and an elongated vertical edge surface is first provided. An elongated molded-face strip is molded and is then attached to the vertical edge surface of the horizontal deck.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

DESCRIPTION OF THE PREFERRED EMBODIMENTS

The method of the present invention begins with the production of a prototype design that will work as an add-on molded edge treatment. The prototype can be made of any easily worked material such as wood or plastic. Because a finished product may be offered in lengths of up to 12½ feet, several sections may be joined end to end to produce the prototype.

Figure 1:
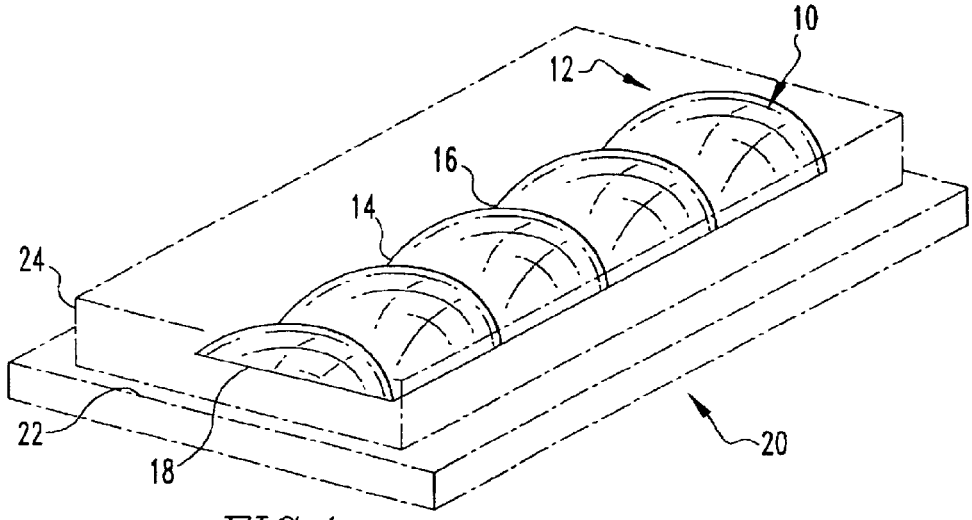
FIG. 1 is a front and side perspective view of a prototype and form from which a mold will be made according to the method of the present invention.

The prototype is then attached to a form. The prototype may be coated with paint, gelcoat and the like, to cover any defects, seams and the like. Once the desired finish is achieved, the prototype is then prepared for a rubber molding material by boxing in the original. Referring to FIG. 1, the prototype 10 has a convex upper surface 12 with a plurality of transverse recesses as at recess 14 and recess 16. The prototype 10 also has a planar lower surface 18. The prototype 10 is positioned in a form 20 which has a base surface 22 and a peripheral wall 24 so that the planar lower surface 18 of the prototype 10 is superimposed on the base surface 22 of the form 20.

Figure 2:
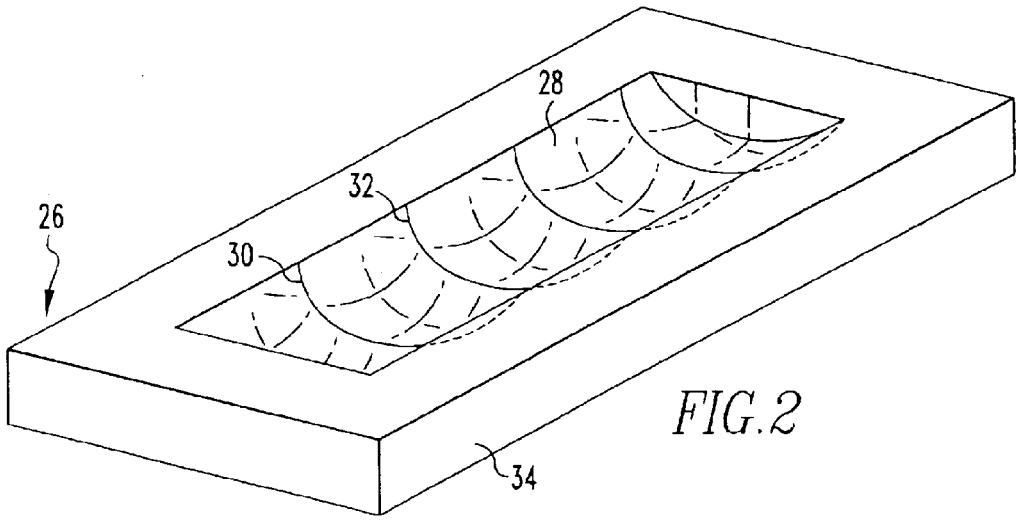
FIG. 2 is a front and side perspective view of the mold made from the prototype and form shown in FIG. 1.

Referring to FIG. 2, a suitable mold is generally shown at numeral 26. This mold 26 has an elongated concave central recess 28 with a plurality of transverse ridges as at ridge 30 and ridge 32, all of which are surrounded by a peripheral wall 34. A suitable molding compound comprised of appropriate resins, fillers and pigments is then injected into the rubber mold to produce the edge treatments. The filler would ordinarily be used in an amount of 40–50% by weight of the entire composition. The most typical process is to first spray a thin coat of gelcoat into the mold. This step is for two reasons. First the spray process allows a coating of rubber mold that eliminates air entrapment at the surface so air bubbles are not visible. Secondly, it allows the application of special surface appearances. Once the coating has cured we then cast a back-up matrix into the mold against the coating. Typically this matrix is mixed and then put under a vacuum to remove air, to achieve a solid surface appearance. After the matrix has cured the elongated molded face strip is then run through a sander so the backside on all the different edges has the proper finish to be attached to a countertop. For solid surface counters, the recommended seaming adhesive of that particular manufacturer is preferably used. The solid surface countertop is fabricated to size. Then the molded face strip is dry fitted to the countertop. Adhesive is applied, and the molded face strip is held in position by tape or clamps. After the adhesive has cured then a light sanding at the seam finishes these two pieces together and makes them appear seamless. In some cases a build up on the underside of the countertop may be necessary for support.

The elongated molded face strip can be applied to a laminate or solid surface countertop using the following steps. Once the laminate is adhered to the wood substrate top, a router is used to trim the excess laminate from the edge that will have the elongated molded face strip all but for 1/16" overhang. The elongated molded face strip is then glued to the wood front and under the 1/16" overhang of the laminate. A preferred adhesive is E6100, manufactured by Eclectic Products, Inc. of Pineville, La. 71360. For a flush mount the laminate would be cut exact without an overhang and the elongated mold face strip is mounted flush with the top of the laminate. When mounting the elongated molded face strip to other surfaces, edges or countertop material such as natural granite, marble, stone and the like, the same adhesive can be used. Again some build up on the underside may be needed for additional support.

Figure 3:
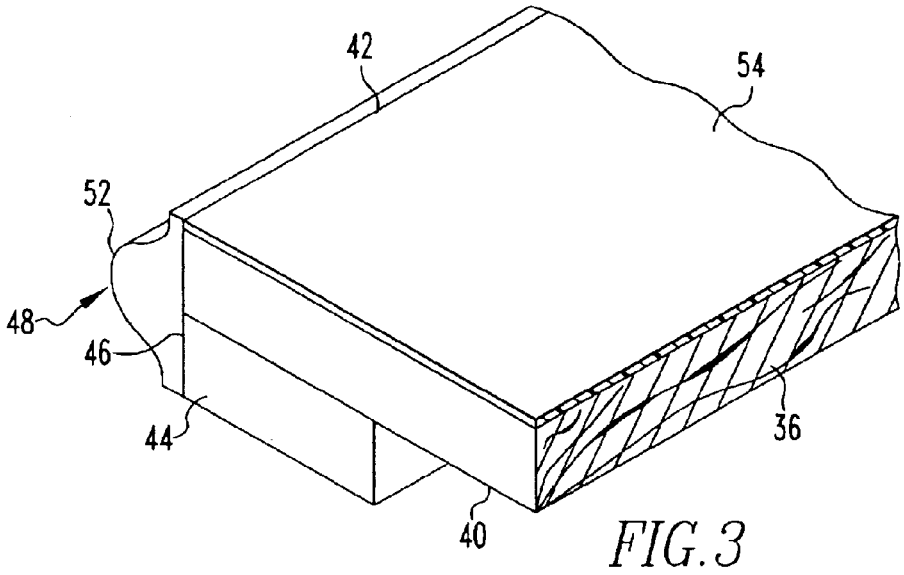
FIG. 3 is a front and side perspective view in fragment of a preferred embodiment of the countertop assembly of the present invention.

Referring to FIG. 3, the assembled countertop has a preferably horizontal deck 36 with an upper surface 38 and a lower surface 40. The horizontal deck 36 also has a front vertical edge surface 42, and its lower surface 40 is superimposed on a build up member shown generally at 44 which also has a front vertical edge surface 46 that is vertically aligned with the front vertical edge surface 42 of the horizontal deck 36. Superimposed on the front vertical edge surface 42 of the horizontal deck 36 and the front vertical edge surface 46 of the build up member 44 there is a elongated molded face strip 48. This elongated face strip 48 has a planar rear surface 50 and a convex front surface 52. The planar rear surface 50 is attached to the front vertical edge surface 42 of the horizontal deck 36 and the front vertical edge surface 46 of the build up member 44 by a suitable adhesive such as E6100 which is commercially available from Eclectic Products, Inc. located at Pineville, La. 71360.

Figure 4:
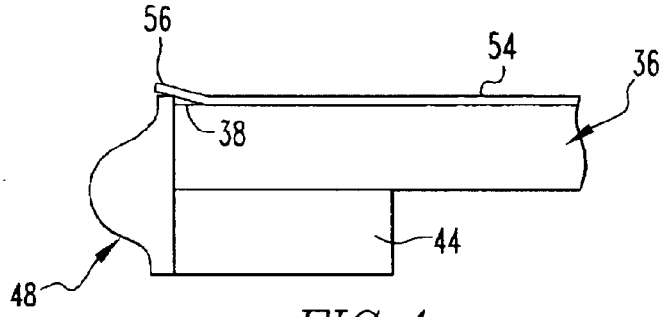
FIG. 4 is a front end view of the countertop assembly shown in FIG. 3 prior to the final application of the laminate.

Referring particularly to FIG. 4, after the build up member 44, elongated face strip 48 and the horizontal deck 36 have been assembled, the laminate 54 is superimposed on the upper surface 38 of the horizontal deck 36. A suitable laminate is commercially available from Formica Corp. located at Cincinnati, Ohio under the product number/trade name Formica Brand Laminate. At this point in the assembly of the countertop, the laminate 54 extends beyond the front vertical edge surface 42 of the horizontal deck 36 by about 1/16" which is shown as overhang 56.

Figure 5:
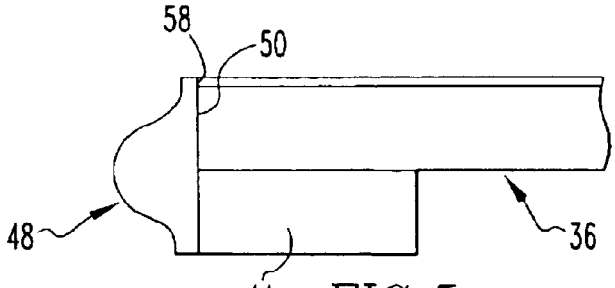
FIG. 5 is a front end view of the countertop assembly shown in FIG. 3 after the final application of the laminate.

Referring to FIG. 5, the countertop assembly is completed by cutting this overhang 56 so that a front vertical edge 58 of the laminate is formed which is vertically aligned with the front vertical edge surface 42 of the horizontal deck 36 and which is positioned beneath the planar rear surface 50 of the elongated face strip 48. Additionally, the countertop laminate could be trimmed flush with the edge of the upper surface prior to placement of the elongated face strip 48. Alternatively, the countertop horizontal deck 36 may be manufactured of a solid surface such that horizontal deck 36 is a homogenous compound extending entirely through the thickness thereof, without departing from the spirit of the present invention.

Figure 6:
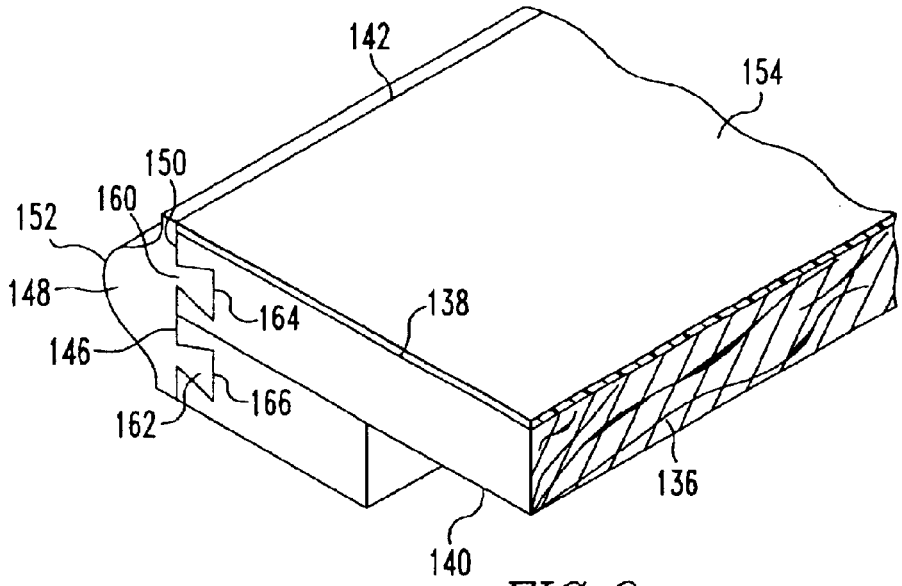
FIG. 6 is a front and side perspective view in fragment of an alternate preferred embodiment of the countertop assembly of the present invention.

Referring to FIG. 6, the assembled countertop has a preferably horizontal deck 136 with an upper surface 138 and a lower surface 140. The horizontal deck 136 also has a front vertical edge surface 142, and its lower surface 140 is superimposed on a build up member shown generally at 144 which also has a front vertical edge surface 146 that is vertically aligned with the front vertical edge surface 142 of the horizontal deck 136. Superimposed on the front vertical edge surface 142 of the horizontal deck 136 and the front vertical edge surface 146 of the build up member 144 there is a elongated molded face strip 148. This elongated face strip 148 has a planar rear surface 150 and a convex front surface 152. The planar rear surface 150 is attached to the front vertical edge surface 142 of the horizontal deck 136 and the front vertical edge surface 146 of the build up member 144 by a suitable adhesive. This embodiment also includes tongues 160 and 162 which extend inwardly from the planar rear surface 150 of the elongated face strip 148. There is also an axial groove 164 which extends inwardly from the front vertical edge 142 of the horizontal deck 136. There is also a groove 166 extending inwardly from the front vertical edge surface 146 of the build up member 144. Tongues 160 and 162 engage respectively grooves 164 and 166 to retain the elongated face strip 148 on the horizontal deck 136 and the build up member 144.

Figure 7:
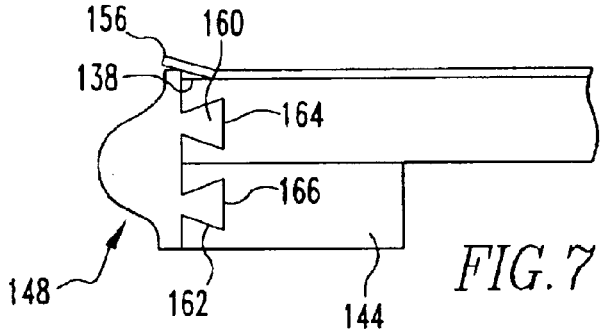
FIG. 7 is a front end view of the countertop assembly shown in FIG. 3 prior to the final application of the laminate.

Referring particularly to FIG. 7, after the build up member 144, elongated face strip 148 and the horizontal deck 136 have been assembled, the laminate 154 is superimposed on the upper surface 138 of the horizontal deck 136. At this point in the assembly of the countertop, the laminate 154 extends beyond the front vertical edge surface 142 of the horizontal deck 136 by about 1/16" which is shown as overhang 156.

Figure 8:
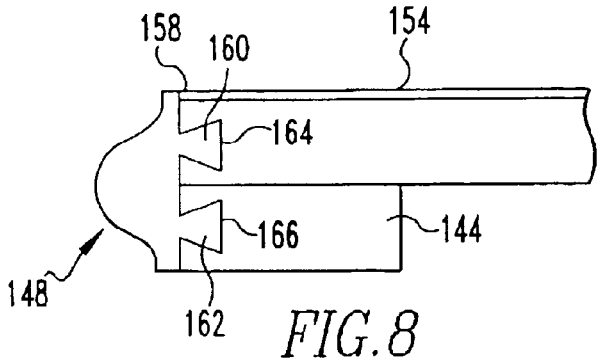
FIG. 8 is a front end view of the countertop assembly shown in FIG. 7 after the final application of the laminate.

Referring to FIG. 8, the countertop assembly is completed by cutting this overhang 156 so that a front vertical edge 158 of the laminate is formed which is vertically aligned with the front vertical edge surface 142 of the horizontal deck 136 and which is positioned beneath the planar rear surface 150 of the elongated face strip 148.

Figure 9:
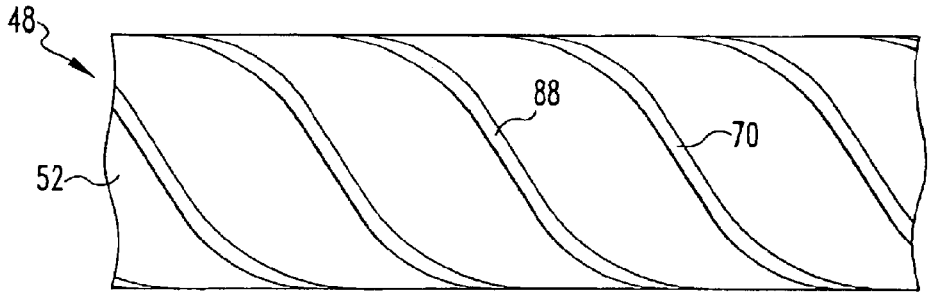
FIG. 9 is a fragmented front elevational view of an alternate elongated molded face strip as may be used in the countertop assembly shown in FIGS. 3 or 6 displaying a pattern of discrete generally traverse groove.

Referring to FIG. 9, the convex front surface 52 of the elongated face strip 48 has a plurality of angled, generally transverse recesses as at recess 88 and 70. It will be appreciated that other aesthetically pleasing designs may also be presented on the front face of the elongated face strip 48.

Figure 10:
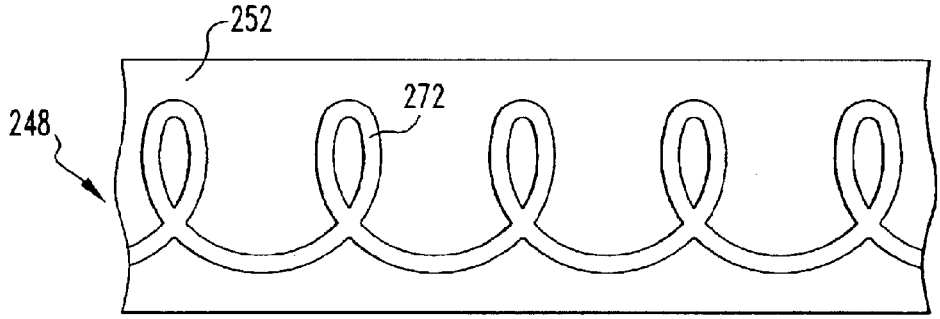
FIG. 10 is a fragmented front elevational view of an alternate elongated molded face strip as may be used in the countertop assembly shown in FIGS. 3 or 6 displaying a longitudinal continuous ridge pattern.

Referring, for example, to FIG. 10, in another embodiment there is an elongated face strip 248 on which a continuous ridge in a wave shaped pattern 272 is presented on the convex front surface 252.

Figure 11:
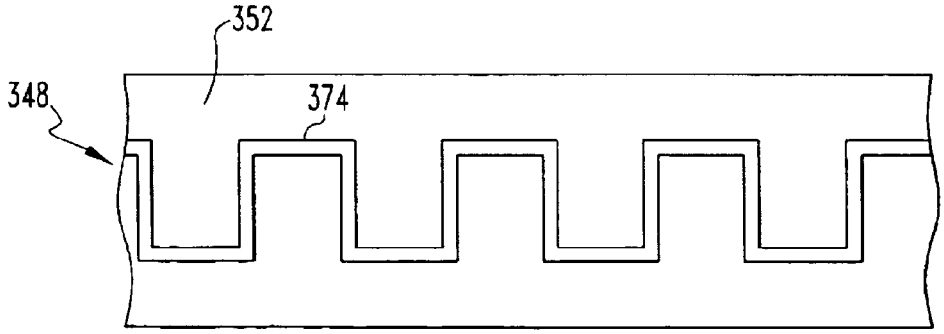
FIG. 11 is a fragmented front elevational view of an alternate elongated molded face strip as may be used in the countertop assemblies shown in FIGS. 3 or 6 displaying a longitudinal continuous recess pattern.

Referring to FIG. 11, still another alternative embodiment is shown in which a continuous recess in a square waved shaped pattern 374 is presented on the convex front surface 352 of an elongated face strip 348.

Figure 13:
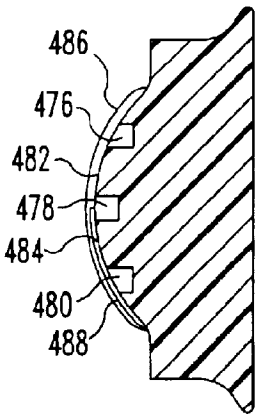
FIG. 13 is a sectional view taken on line 13—13 of FIG. 12.
Figure 14:
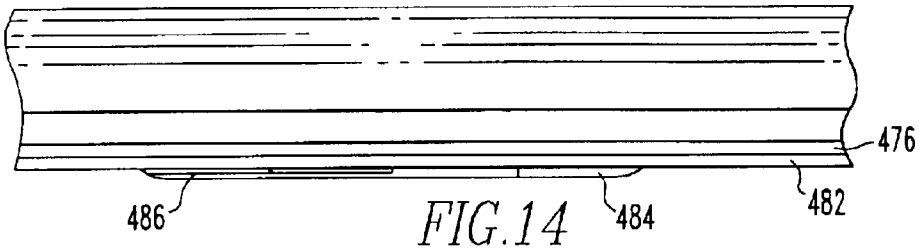
FIG. 14 is a top plan view of the molded face strip shown in FIG. 12.
Figure 12:
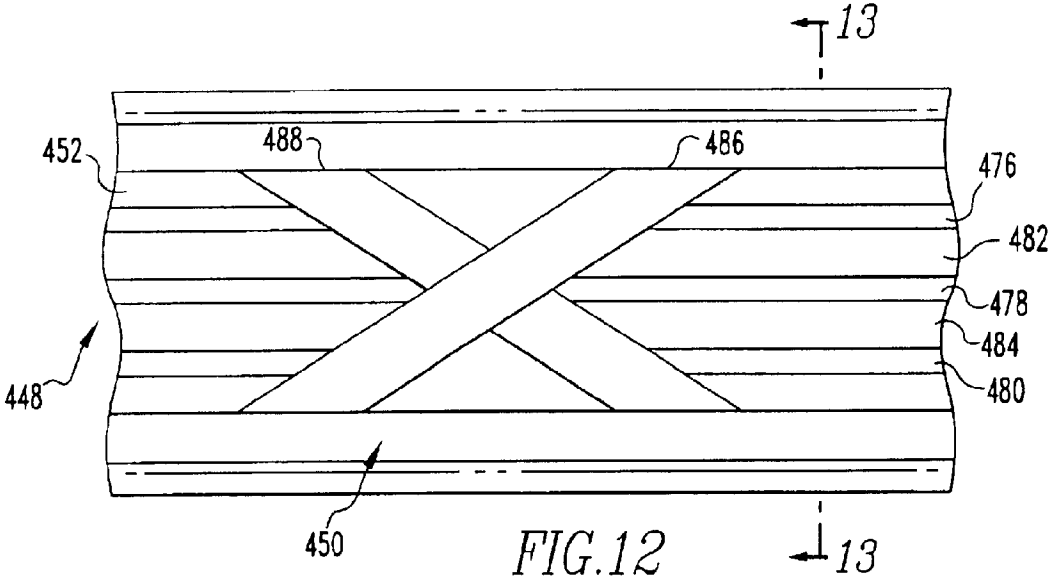
FIG. 12 is a fragmented front elevational view of an alternate elongated molded face strip as may be used in the countertop assemblies shown in FIGS. 3 or 6 displaying a pattern comprised of a plurality of discreet longitudinal ribs and recesses in combination with generally transverse ridges.

Referring to FIGS. 12–14, still another alternative embodiment is shown in which there is an elongated face strip 448 with a convex front surface 452 on which there are a plurality of longitudinal recesses as at recesses 476, 478 and 480 which are alternated with longitudinal ridges as at ridges 482 and 484. There are also angled ridges 486 and 488 which are superimposed over the above described ridges and recesses to form a cross such that ridge 486 is superimposed over ridge 488.

EXAMPLE

The method of the present invention is further described with reference to the following example. The prototype elongated face strip, similar to the one shown above in FIG. 1, was made from wood. This prototype was positioned in a form also similar to the one shown in FIG. 1 and a rubber molding material obtained from Polytek located at 55 Hilton St. Easton, Pa. 18042 under product number/trade name Tinsil 70–30 RTV Silicone Rubber was poured over the original and allowed to cure to produce a rubber mold similar to the one shown in FIG. 2. A thin coat of gelcoat was applied to the mold and allowed to cure for 20 minutes. A catalyzed resin and filler matrix molding compound was used in which the resin was obtained from Reichhold Chemicals, Inc. located at Research Triangle Park, N.C. 27709 under product number/trade name resin 32–166 and the filler was used in the amount of 40% by weight and was obtained under the trademark POLYSTONE from ACS International, Inc. located at 4625 South 3$^{rd}$ Ave. Tucson, Ariz. 55714. This molding compound was injected into the mold and allowed to cure for 120 minutes at room temperature. A horizontal deck and build up members were then constructed of wood in the way described above after which the elongated face strip was attached to the horizontal deck and the build up member by means of an adhesive obtained from Eclectic Products, Inc. located at Pineville, La. 71360 under product number E6100. The elongated face strip was clamped to the horizontal deck and the build up member during the 24 hours for which the adhesive was allowed to cure.

It will be appreciated that a countertop with a curved front edge and a method for its construction has been described in which a large variety of aesthetically pleasing patterns may be presented.

It will also be appreciated that a countertop with a rounded front edge and a method for its manufacture has been described in which a variety of materials having advantageous characteristics in terms of durability, finish, color and other factors may be used.

It will also be appreciated that a front edge may also be used which has a shape other than a rounded front edge.

Accordingly, the improved COUNTERTOP ASSEMBLY AND METHOD OF MANUFACTURE THEREOF is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the COUNTERTOP ASSEMBLY AND METHOD OF MANUFACTURE THEREOF is constructed and used, the characteristics of the construction, and the advantageous new and useful results obtained; the new and useful structures, devices, elements, arrangements, parts, and combinations are set forth in the appended claims.

What is claimed is:

1. A method of manufacturing a countertop assembly comprising the steps of:

providing a horizontal deck having an upper and a lower surface and an elongated vertical edge surface;

providing an elongated molded strip formed as an integral one-piece member and having an exposed outer surface defining a non-extrudable shape; the shape defined by the outer surface including a first three-dimensional pattern and a second three-dimensional pattern which is distinct from the first three-dimensional pattern; wherein a portion of the first pattern extends transversely to and is superimposed over a portion of the second pattern;

fixing the elongated molded strip to the elongated vertical edge surface of the horizontal deck.

2. The method of manufacturing a countertop assembly of claim 1 wherein the elongated strip is generally convex.

3. The method of manufacturing a countertop assembly of claim 1 wherein the outer surface of the elongated molded strip comprises at least one ridge.

4. The method of manufacturing a counter assembly of claim 1 wherein the outer surface comprises at least one recess.

5. The method of manufacturing a countertop assembly of claim 1, wherein the outer surface of the elongated molded strip comprises a continuous ridge or recess.

6. The method of manufacturing a countertop assembly of claim 1 wherein the outer surface of the elongated molded strip comprises a plurality of discrete ridges or recesses.

7. The method of manufacturing a countertop assembly of claim 6 wherein the outer surface of the elongated molded face strip comprises at least one ridge.

8. The method of manufacturing a countertop assembly of claim 1 wherein the elongate molded strip is comprised of a polymeric material.

9. The countertop assembly of claim 1 wherein the elongated molded face strip has an inner surface and said face strip is attached to the elongated vertical edge surface of the horizontal deck at said inner surface.

10. The method of manufacturing a countertop assembly of claim 1 wherein the elongate molded strip is connected to the elongated vertical surface of the horizontal deck by a tongue and groove joint.

11. The method of manufacturing a countertop assembly of claim 1 wherein a planar protective covering is superimposed on the upper surface of the horizontal deck.

12. The method of manufacturing a countertop assembly of claim 11 wherein the protective covering is a laminate.

13. The method of manufacturing a countertop assembly of claim 1 wherein the lower surface of the horizontal deck is vertically superimposed on an elongated build up member having an elongated vertical edge surface which is vertically aligned with the elongated vertical edge surface of the horizontal deck, and the horizontal molded face is superimposed over both the elongated vertical edge surface of the horizontal deck and the elongated vertical edge surface of the elongated build up member.

14. The method of manufacturing a countertop assembly of claim 13 wherein a planar protective covering is superimposed on the upper surface of the horizontal deck.

15. The method of manufacturing a countertop assembly of claim 14 wherein the protective covering is a laminate.

16. The method of manufacturing a countertop assembly of claim 15 wherein the planar protective covering has an elongated front vertical edge surface which is vertically aligned with the elongated front vertical edge surface of the horizontal deck and the build up member.

17. The method of claim 1 wherein the elongated molded strip has a longitudinal length in the elongated direction of the strip and wherein on the exposed outer surface there is a pattern along the longitudinal length.

18. The method of claim 3 wherein the at least one ridge is transverse to the elongated direction of the strip.

19. The method claim 4 wherein the at least one recess is transverse to the elongated direction of the strip.

20. The method of claim 11 wherein the elongated molded strip has a rear surface fixed to the elongated vertical edge surface of the horizontal deck and an upper edge projecting above the upper surface of the horizontal deck adjacent thereto; wherein the planar protective coating overhangs the horizontal deck elongated vertical edge surface to form an overhang disposed above the upper edge of the elongated molded strip; and wherein the method further includes the steps of:

cutting the overhang to form a vertical edge of the planar protective coating which is aligned with the vertical edge of the horizontal deck; and positioning the protective coating vertical edge behind the elongated molded strip adjacent the rear surface thereof.

21. A method of manufacturing a countertop assembly comprising the steps of:

providing a horizontal deck having an upper and a lower surface and an elongated vertical edge surface;

providing an elongated molded strip formed as an integral one-piece member and having an expose outer surface defining at least one of a ridge and a recess transverse to the elongated direction of the strip whereby the outer surface defines at least first and second three-dimensional patterns which are distinct from one another and wherein portion of the first pattern extends transversely to and is superimposed over the second pattern;

fixing the elongated molded strip to the elongated vertical edge surface of the horizontal deck.

22. The method of claim 21 wherein the outer surface defines a pattern which repeats at least once in the elongated direction of the strip.

23. The method of claim 21 wherein a planar protective covering is superimposed on the upper surface of the horizontal deck; wherein the elongated molded strip has a rear surface fixed to the elongated vertical edge surface of the horizontal deck and an upper edge projecting above the upper surface of the horizontal deck adjacent thereto; wherein the planar protective coating overhangs the horizontal deck elongated vertical edge surface to form an overhang disposed a above the upper edge of the elongated molded strip; and wherein the method further includes the steps of:

cutting the overhang to form a vertical edge of the planar protective coating which is aligned with the vertical edge of the horizontal deck; and positioning the protective coating vertical edge behind the elongated molded strip adjacent the rear surface thereof.

24. A method of manufacturing a countertop assembly comprising the steps of:

batch cast molding an elongated strip as an integral one-piece member;

providing a horizontal deck having an upper and a lower surface and an elongated vertical edge surface; and fixing the elongated molded strip to the elongated vertical edge surface of the horizontal deck when by the molded strip has an exposed outer surface defining at least first and second three-dimensional patterns which are distinct from one another; a portion of the first pattern extending transversely to and being superimposed over a portion of the second pattern.

25. The method of claim 24 wherein the exposed outer surface defines at least one of a ridge and a recess transverse to the elongated direction of the strip.

26. The method of claim 24 wherein the elongated molded strip has a longitudinal length in the elongated direction of the strip and wherein the exposed outer surface defines a pattern along the longitudinal length.

27. The method of claim 24 wherein the outer surface includes at least one ridge transverse to the elongated direction of the strip.

28. The method of claim 24 wherein the outer surface includes at least one recess transverse to the elongated direction of the strip.

29. The method of claim 24 wherein a planar protective covering is superimposed on the upper surface of the horizontal deck; wherein the elongated molded strip has a rear surface fixed to the elongated vertical edge surface of the horizontal deck and upper edge projecting above the upper surface of the horizontal deck adjacent thereto; wherein the planar protective coating overhangs the horizontal deck elongated vertical edge surface to form an overhang disposed above the upper edge of the elongated molded strip; and wherein the method further includes the steps of:

cutting the overhang to form a vertical edge of the planar protective coating which is aligned with the vertical edge of the horizontal deck; and positioning the protective coating vertical edge behind the elongated molded strip adjacent the rear surface thereof.

30. The method of claim 1 wherein another portion of the first pattern is not superimposed over the second pattern.

31. The method of claim 21 wherein another portion of the first pattern is not superimposed over the second pattern.

32. The method of claim 24 wherein another portion of the first pattern is not superimposed over the second pattern.

33. The method of claim 25 wherein the exposed outer surface has an upper edge and a lower edge; and wherein the at least one of a ridge and a recess extends transversely from the upper edge to the lower edge.

34. The method of claim 1 wherein the elongated strip is formed of a single-composition material.

35. The method of claim 1 wherein the entire outer surface of the molded strip is exposed.

36. The method of manufacturing a countertop assembly of claim 21 wherein the outer surface of the elongated molded strip comprises a plurality of discrete ridges or recesses.

37. The method of claim 21 wherein the entire outer surface of the molded strip is exposed.

38. The method of claim 24 wherein the exposed outer surface has an upper edge and a lower edge; and wherein the at least one of a ridge and a recess extends transversely from the upper edge to the lower edge.

39. The method of claim 24 wherein the elongated strip is formed of a single-composition material.

40. The method of claim 24 wherein the entire outer surface of the molded strip is exposed.

* * * * *

UNITED STATES PATENT AND TRADEMARK OFFICE

CERTIFICATE OF CORRECTION

PATENT NO. : 6,945,006 B2
DATED : September 20, 2005
INVENTOR(S) : John F. Stoffer It is certified that error appears in the above-identified patent and that said Letters Patent is hereby corrected as shown below:

Column 6,
Line 60, replace “elongate” with -- elongated --.
Line 67, replace “elongate” with -- elongated --.

Column 7,
Line 29, add -- repeated -- before “pattern”.
Line 33, add -- of -- after “method”.
Line 55, replace “expose” with -- exposed --.
Line 60, add -- a -- before “portion”.

Column 8,
Line 9, delete “a” before “above”.
Line 25, replace “when by” with -- whereby --.
Line 37, add -- repeated -- before “pattern”.

Signed and Sealed this

Twentieth Day of December, 2005

JON W. DUDAS
*Director of the United States Patent and Trademark Office*